US007090075B1

(12) United States Patent
Rocha

(10) Patent No.: US 7,090,075 B1
(45) Date of Patent: Aug. 15, 2006

(54) GOLF BAG

(76) Inventor: Nicasio I. Rocha, 2309 Millford La. West, Jacksonville, FL (US) 32246

( * ) Notice: Subject to any disclaimer, the term of this patent is extended or adjusted under 35 U.S.C. 154(b) by 157 days.

(21) Appl. No.: 10/273,931

(22) Filed: Oct. 17, 2002

Related U.S. Application Data

(60) Provisional application No. 60/392,847, filed on Jul. 1, 2002, provisional application No. 60/330,067, filed on Oct. 17, 2001.

(51) Int. Cl.
*A63B 55/00* (2006.01)
*A63B 55/02* (2006.01)

(52) U.S. Cl. ..... 206/315.2; 206/315.3; 206/315.6; 211/70.2

(58) Field of Classification Search ..... 206/315.2, 206/315.3, 315.5, 315.8, 315.6; 211/70.2
See application file for complete search history.

(56) References Cited

U.S. PATENT DOCUMENTS 1,868,979 A * 7/1932 Hotze ..... 224/613
2,364,223 A * 12/1944 Keim ..... 206/315.3
2,435,479 A * 2/1948 Thommen ..... 206/315.8
2,471,169 A * 5/1949 Salzberg et al. ..... 206/315.4
2,595,987 A 5/1952 Shears
2,704,562 A * 3/1955 Gordon ..... 206/315.8
3,128,812 A * 4/1964 Scheurer ..... 206/315.4
3,674,072 A 7/1972 Shuto
4,266,589 A 5/1981 Cochran
4,378,039 A 3/1983 Suk
4,635,793 A 1/1987 Kim
4,779,725 A 10/1988 Gerber
4,838,416 A 6/1989 Carman
4,911,292 A 3/1990 Airey, Jr.
D318,566 S 7/1991 Henry
D322,831 S * 12/1991 Cantwell ..... D3/259
5,102,529 A 4/1992 Hickin
5,123,531 A 6/1992 Beretta
5,238,109 A * 8/1993 Smith ..... 206/315.2
5,332,090 A 7/1994 Tucker
5,341,928 A 8/1994 Jones et al.
5,358,109 A 10/1994 Nichols
D352,392 S 11/1994 Little
5,415,285 A 5/1995 Reimers
5,465,840 A 11/1995 Joh
5,472,084 A 12/1995 Aliano, Jr.
5,472,251 A 12/1995 Deininger
5,474,175 A 12/1995 Gattis
D372,126 S 7/1996 Martinez et al.

(Continued)

FOREIGN PATENT DOCUMENTS

GB 16422 * 12/1913 ..... 206/315.2

(Continued)

OTHER PUBLICATIONS

Pelz, Dave, *Dave Pelz's Short Game Bible: Master the Finesse Swing and Lower Your Score,* May 1999, pp. 1-448, 1st edition, Broadway Books.

(Continued)

*Primary Examiner*—Sue A. Weaver

(57) ABSTRACT

The subject invention relates generally to a golf bag which can be used to carry one or more golf clubs and/or other golf related items. The subject golf bag can be attached to a standard golf bag, for example mounted to a golf cart. In a specific embodiment, the subject invention pertains to a collapsible golf bag which can be significantly reduced in size when not in use, allowing the collapsible golf bag to be carried or stored in a smaller space such as a tote bag or pocket on another golf bag.

16 Claims, 13 Drawing Sheets

U.S. PATENT DOCUMENTS

| | | | | |
|---|---|---|---|---|
| 5,590,773 | A * | 1/1997 | Robinett | 206/315.1 |
| 5,632,496 | A | 5/1997 | Nelson | |
| 5,765,691 | A | 6/1998 | Hall | |
| D399,347 | S | 10/1998 | Larko et al. | |
| 5,816,396 | A | 10/1998 | Shin | |
| 5,829,604 | A | 11/1998 | Brophy | |
| 5,860,520 | A | 1/1999 | Tang | |
| 5,918,737 | A | 7/1999 | Kwon | |
| 5,984,395 | A | 11/1999 | Halpen | |
| 6,036,009 | A * | 3/2000 | Kim | 206/315.3 |
| D433,566 | S | 11/2000 | Larko | |
| 6,227,427 | B1 | 5/2001 | Kunz | |
| 6,330,944 | B1 * | 12/2001 | DeMichele | 206/315.3 |
| 6,383,088 | B1 * | 5/2002 | Kershner | 473/282 |
| 2002/0066763 | A1 * | 6/2002 | Hsuch | |
| 2002/0144917 | A1 * | 10/2002 | Barrise et al. | |

FOREIGN PATENT DOCUMENTS

| | | | | |
|---|---|---|---|---|
| GB | 150578 | * | 9/1920 | 206/315.2 |
| WO | WO9118650 | * | 12/1991 | 206/315.3 |

OTHER PUBLICATIONS

One Sided Flyer on Invention "The B.Ultralite Collapsible Golf Bag".
Sample of Invention.
One Sided Flyer on Invention.
Two Sided Flyer on Invention.
Burton Golf Corporate Catalog '04.
Golf Inc. Article by Jessica Anderson.
Instruction Sheet on Invention.
Burton Golf Catalog '04.

* cited by examiner

GOLF BAG

CROSS-REFERENCE TO RELATED APPLICATION(S)

The present application claims priority to U.S. provisional application Ser. No. 60/330,067, filed Oct. 17, 2001 and U.S. provisional application Ser. No. 60/392,847, filed Jul. 1, 2002, which are hereby incorporated by reference herein in their entirety, including any figures, tables, or drawings.

BACKGROUND OF INVENTION

Many golfers ride a cart when playing golf. Managers of golf courses prefer that there be two people in one cart and two carts in one group. In golf course management, time is money because revenues are based on the number of golfers that will fit into the tee time slots. A group of golfers typically tee off every 10 minutes or so, and finish in approximately four hours. Courses have starters making sure golfers start on time. They may also have rangers to monitor the golfers and to make sure there are no delays in the procession of players across the entire course. The management can maximize revenues if they can fill these tee time slots and have players finish on time. Slow play has been the bane of cart playing golfers since the surge in golf's popularity.

Motorized cart golf has become a slower game. This is because two golfers are joined together by onegolf cart, making it difficult to move independently from one another. Unfortunately, the majority of golfers don't strike the ball down the middle of the fairway all the time. This would make riding in one cart more practical. Instead, the ball is often struck away from the center of the fairway. As a result, cart golfers tend to drive a zigzag pattern from one side of the fairway to the other chasing each other's shot.

Sometimes, conscientious golfers realize that they can "break away" from their playing partner by grabbing a collection of clubs needed to advance the ball to the hole. This speeds up the pace of golf. When a golfer walks independently from the cart, by necessity, the golfer often has to carry more than one club. If a golfer's intention is to finish the hole in this manner, at the minimum the golfer often has to carry at least two clubs, the putter and one other to advance the ball. It is not uncommon to see golfers carrying many clubs. Each shot requires a different club, depending upon which part of the fairway the golfer decides to play. This creates the added burden to the golfer who may have to carry four or more clubs.

There are at least two more situations concerning the transport of golf clubs away from the golf cart. First, a common occurrence after heavy rains or delicate course conditions is restriction of all motorized golf carts to travel only on the cart paths, often referred to as, the Cart Paths Only. In this instance, a method of transporting several clubs from the cart path to the golf ball would be helpful. The golfer can only assume the conditions surrounding the next shot, because the ball is some distance away. Factors such as lie, wind direction, angle to the green, or hazards are often apparent only after arriving to the ball. A prudent golfer would prefer to bring at least two clubs. Again, an issue here is transport, as well as the concern over laying a club down on wet ground, resulting in wet and/or dirty grips.

Another scenario in which one or more clubs need to be transported away from the cart is pitching and chipping. Golf course rules often restrict the presence of golf carts proximate to the greens. For example, golf carts may not be allowed within 50 yards of the green. If the golf ball is clearly resting on the putting green, the putter may be the only club which needs to be pulled from the bag. On the other hand, if the approach shot did not land on the green, the lie, its direction, and relationship to the hole, usually are not clear until the golfer is standing directly over the ball. In addition, it may not be clear how the golfer wants the ball to fly and land on the putting surface, for example, high and soft, low and fast, stop as it lands, or continue rolling towards the hole. The golfer may prefer to choose between several clubs after determining the desired shot selection.

One of golf's foremost experts on the short game, Dave Pelz, had this to say about scoring: "In golf, how you play inside of 100 yards is the prime determinant of how you score." This is the first sentence of the first chapter in his book, *Dave Pelz's Short Game Bible*. After 23 years of researching the game, studying golfers, and compiling data, Pelz results show that 60% to 65% of all shots occur inside of 100 yards. Pelz recommends that golfers carry a putter and four wedges within one hundred yards of the green. The four wedges include a pitching wedge, a sand wedge, a lob wedge, and an extra lofted wedge. Pelz's goes on to say that if you could develop three types of swings, a full, ¾, and ½ speed swing using the aforementioned clubs, a golfer could have 12 reliable shots from within 100 yards, 4 clubs×3 swings=12. Once a golfer can execute these shots and become more educated, a golfer can significantly improve scoring ability and enjoy the game more. The obstacle facing most golfers attempting to utilize this proven method is that the golfer must have these clubs in hand, carried loosely, around the green until the hole is finished. This is a difficult task and often results in wet dirty grips from having to lay the clubs on the ground or perhaps even lost clubs.

Accordingly, there is a need for a means for transporting one or more golf clubs away from a golf cart. The subject application relates to an apparatus for carrying a plurality of golf clubs and/or golf related items. In a specific embodiment, the subject invention relates to a collapsible golf bag which has a means for connecting to another standard golf bag. The subject invention can allow a golfer to "break away" from their golf cart by allowing the golfer to easily carry one or more clubs needed to advance the ball to the hole. The golf bag of the subject invention can be collapsed to a size for easy carrying or storage. When ready for use, the collapsible golf bag of the subject invention can be expanded to allow the golfer to carry a plurality of clubs to the ball and allow the golfer to complete the shot with the correct club. The subject golf bag can prevent the golfer from having to carry numerous clubs in hand and reduce the risk of leaving clubs on the green. When not in use the collapsible golf bag, for example, can remain attached to, or stored in, the standard golf bag. In this way, the subject golf bag will not impede regular is ready for use when needed. The use of the subject golf bag can speed up the pace of a golf game, reduce the occurrence of lost clubs, and reduce the occurrence of club grips getting wet or dirty when laid on the green.

BRIEF SUMMARY OF THE INVENTION

The subject invention relates generally to a golf bag which can be used to carry one or more golf clubs and/or other golf related items. The subject golf bag can be attached to a standard golf bag, for example mounted to a golf cart. In a specific embodiment, the subject invention pertains to a collapsible golf bag which can be significantly reduced in size when not in use, allowing the collapsible golf bag to be carried or stored in a smaller space such as a tote bag or pocket on another golf bag.

The subject collapsible golf bag can be expanded when desired. The subject collapsible golf bag can carry a plurality of clubs. In a specific embodiment, the subject collapsible golf bag can carry a full set of golf clubs.

The subject golf bag can have pockets for carrying various items. The closed or bottom end of the subject golf bag can be reinforced to aid in supporting the weight of the clubs and help maintain the shape of the collapsible golf bag.

USGA rules allow a golfer to lift, inspect and clean the golf ball only after it comes to rest on the putting green. The subject golf bag can incorporate a means for attaching a towel or cloth to the bag so that it is conveniently available to clean the ball. The subject golf bag may also have a hook and loop means for attachment of a golf glove. Most golf gloves have a hook and loop method for holding the glove on the golfers hand. The subject golf bag could also have a hook and/or loop patch on the bag so that a corresponding loop and/or hook patch of the golf glove could be easily attached to the golf bag, providing a convenient means for holding the glove and thus reducing the chances of losing the glove or having to keep the glove in the golfers pockets.

The subject golf bag can have a handle means which allows the golfer to easily carry the golf bag with or without a plurality of clubs. Optional rigid supports around the main body portion of the subject collapsible golf bag can aid in maintaining the golf bag's shape when in use and may assist in collapsing or expanding the golf bag.

Upon finishing the hole, a golfer can replace the putter and/or other clubs in the subject golf bag and carry it to the standard golf bag. Then, the golfer can attach the subject golf bag to the standard golf bag. The subject golf bag can incorporate an attachment means for allowing attachment of the subject golf bag to another golf bag. In a specific embodiment, the attachment means allows attachment to most, if not all, standard golf bags. In a further specific embodiment, the subject golf bag incorporates a hook for attaching to most, if not all, standard golf bags. This hook can be positioned on the top lip of the standard golf bags or on other solid items of standard golf bags or golf carts, such that the subject golf bag hangs on the standard golf bag, other solid item, or golf cart. As mentioned above, the subject golf bag can remain attached to the standard golf bag during play, ready for use when necessary. In a specific embodiment, the subject golf bag can hold up to a full set of golf clubs, it can even be used instead of a standard golf bag and can be attached to any object, such as a golf cart, when in use. In a specific embodiment, the subject golf bag can be collapsed to a smaller size for easier carrying or perhaps storage. In a specific embodiment, the diameter, and structure of the subject collapsible golf bag can be such that the collapsed golf bag is less than about 9 inches in diameter and less than about 12 inches tall. In a further specific embodiment, the collapsed golf bag is less than about 8 inches in diameter and less' than about 10 inches tall. In an even further specific embodiment, the collapsed golf bag is about 7 inches in diameter and about 9.5 inches tall. Such collapsed dimensions allow convenient storage in, for example, a tote bag or pocket on a standard golf bag.

A specific embodiment of the invention comprises a main body portion comprising a sleeve. The sleeve can be made of a variety of materials, rigid or flexible. In a specific embodiment, the sleeve can comprise a material which can be crushed or folded. A sleeve comprising a material which can be crushed or folded can allow the subject golf bag to be collapsible. Inside the sleeve there may be an inner liner, again of a material which can be crushed or folded. A first end of the sleeve can be attached to a collar. A first end of the inner liner can be attached to the sleeve and/or to the collar. The inner liner can be attached partially or completely to the sleeve. Alternatively, the inner liner can be allowed to move freely with no attachment to the sleeve.

A hook can also be attached to the collar and protrude from the collar and extend some distance lengthwise towards the closed end of the sleeve. This hook can allow attachment of the subject golf bag to another golf bag or to other items such as a golf cart. A carrying handle or strap may be attached to the collapsible golf bag. This handle can attach to the collar and/or to the sleeve. In a specific embodiment, the handle can be attached in such a way that, with a plurality of clubs positioned in the subject golf bag, the golf bag can be held by the handle at a convenient angle.

The main body portion can also have several rigid supports, for example, hoops or ribs, positioned along its length. The rigid supports can aid in maintaining the shape of the sleeve. In a specific embodiment, the rigid supports do not impair the ability of the golf bag to be collapsed. The bottom end of the collapsible golf bag can be reinforced, perhaps with a rigid, or resiliently flexible, bottom piece, to support the weight of the clubs in the golf bag. Such a rigid, or resiliently flexible, bottom piece can aid in maintaining the shape of the golf bag when expanded for use and/or when collapsed.

The subject golf bag can also have storage compartments, a means for attaching a towel, and/or a hook and loop means by which a golf glove may be attached to the golf bag. Other items useful on a standard golf bag could be incorporated for use on the subject golf bag, depending upon the needs and desires of the golfer. This may include various types of stands or supports for the golf bag, various methods for attaching or carrying objects, or perhaps electronics.

The subject golf bag can incorporate a means to assist in collapsing the golf bag. In a specific embodiment, a pulling mechanism such as a string, cord, rope, chain, or similar mechanism can be utilized. This pulling mechanism can be attached to the inner liner, outer sleeve, and/or bottom end of the golf bag. In a specific embodiment, a string can be attached to the bottom of the main body portion, and extend along the length of the expanded main body portion to a point near the open end of the golf bag. The string can protrude from, or be positioned proximate to, the open end of the golf bag such that the string is accessible to the user. To collapse the golf bag, that section of the pulling means protruding from, or positioned proximate to, the top end of the collapsible golf bag can be pulled away from the collapsible golf bag, which draws the portions of the golf bag attached to the string up toward the top end of the golf bag so as to collapse the golf bag into a smaller volume. In a specific embodiment, the string pulls the reinforced bottom of the golf bag towards the collar as the user pulls the string. As the pulling mechanism is pulled through the main body portion, the reinforced bottom can be guided towards the collar. Rigid supports along the main body portion of the golf bag can allow the golf bag to be collapsed, and when expanded can assist in easily opening the sleeve and maintaining its shape during use.

A holding means on the pulling means can assist in holding the pulling means at any position with respect to, for example, the collar, so as to hold the golf bag in a fully or partially collapsed position. Holding the pulling means in the fully extracted position, can aid in maintaining the collapsed condition of the golf bag. When ready for use, the holding means can be released and bottom end of the golf bag can be pulled away from the collar so as to open the golf bag into the uncollapsed position. In an embodiment wherein the pulling mechanism is attached to the bottom end of the bag, the bottom end of the bag can be pulled away from the collar of the golf bag to open the golf bag. In a further specific embodiment, wherein the pulling mechanism is attached to a reinforced bottom of the bag, the reinforced bottom end of the bag can be pulled away from the collar which draws the pulling means back to its fully extended position. Alternative holding mean can, for example, hold the bottom end in position relative to the collar and/or sleeve, rather than hold the pulling mechanism in position relative to the collar and/or sleeve. Optional rigid supports along the sleeve of the collapsible golf bag assist opening the sleeve of the golf bag for insertion of any required clubs. In addition, a means for self-extension of the golf bag can be incorporated. For example, a spring mechanism can be incorporated with the subject golf bag such that pulling the pulling mechanism causes the spring mechanism to compress as the golf bag is collapsed. Upon release of the holding means for holding the golf bag in the collapsed state, the spring mechanism can cause the golf bag to extend back to a fully or partially opened position.

A specific embodiment of the subject invention can allow golfers to use their existing standard golf bags by easily attaching to any standard golf bag. The subject invention is easy to use and assemble. Many features that may be found on a standard golf bag or used with a standard golf bag, such as handles, straps, pocket, and storage areas, can be used with the subject invention. In a specific embodiment, the subject golf bag can be easily collapsed to a size capable of storage within a pouch, pocket, and/or storage area of a standard golf bag.

The subject invention can be lightweight, optionally collapsible, simple, efficient, compact, inexpensive, and attractive.

The invention summarized above and defined by the enumerated claims may be better understood by referring to the following description, which should be read in conjunction with the accompanying drawings in which like reference numbers are used for like parts. This detailed description of an embodiment, set out below to enable one to build and use an implementation of the invention, is not intended to limit the embodiments, but to serve as a particular example thereof. Those skilled in the art should appreciate that they may readily use the conception and specific embodiment disclosed as a basis for modifying or designing other methods and systems for carrying out the same purposes of the present invention. Those skilled in the art should also realize that such equivalent assemblies do not depart from the spirit and scope of the invention in its broadest form.

DETAILED DISCLOSURE

Figure 1:
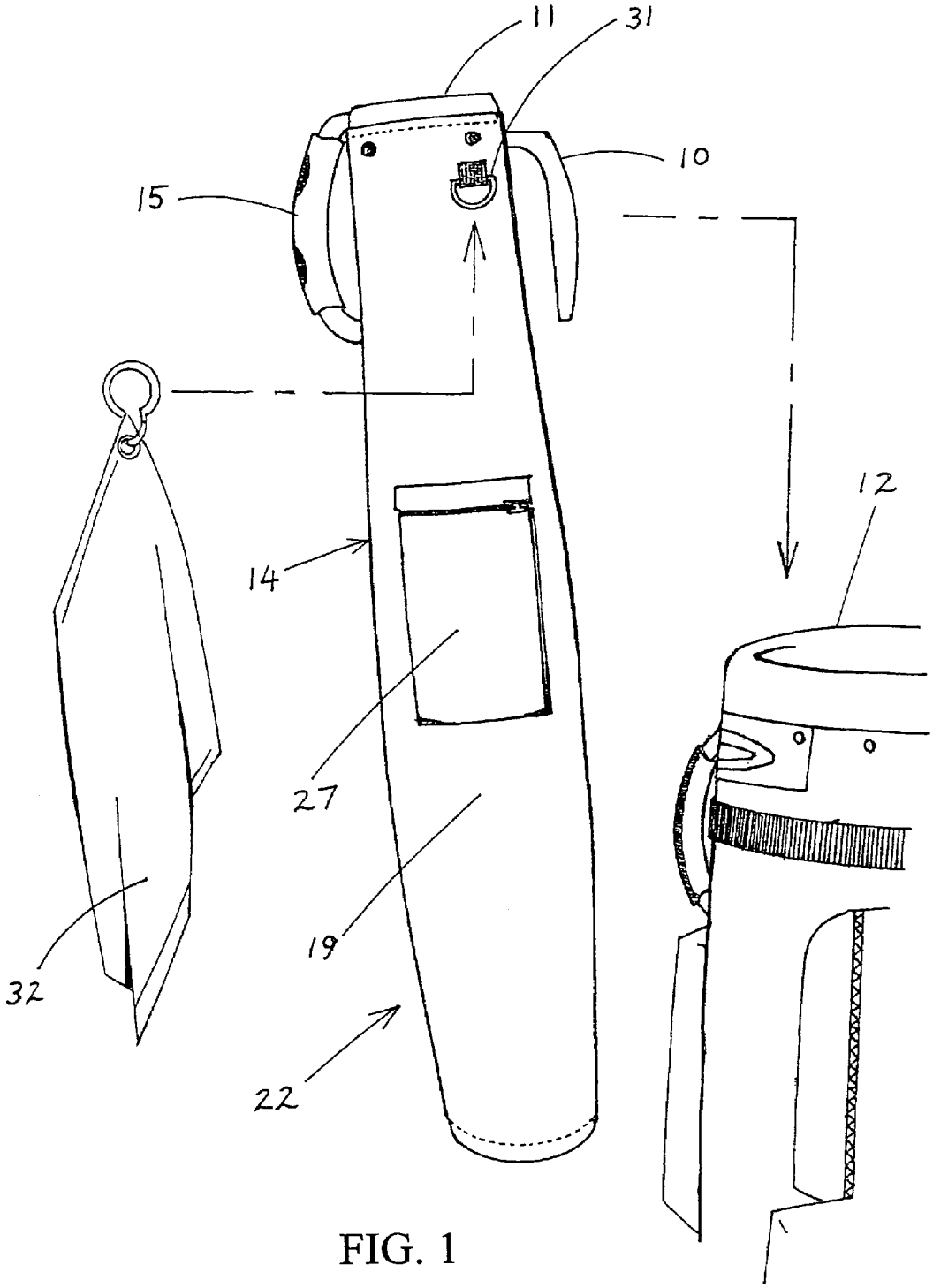
FIG. 1 shows a specific embodiment of the subject collapsible golf bag in a fully open position and shows how the subject golf bag would attach to a standard golf bag and how a golf towel can be attached to the subject invention.
Figure 2:
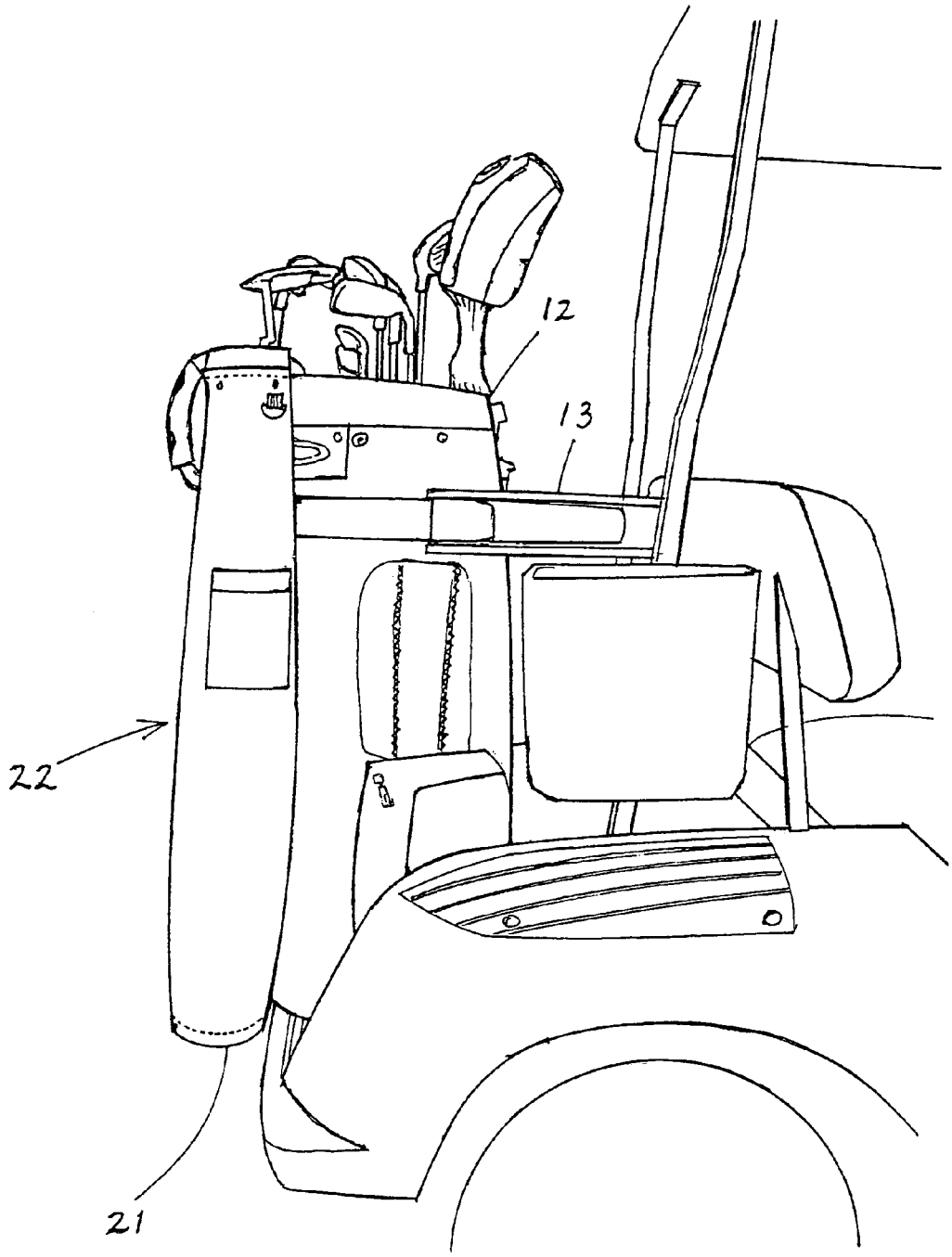
FIG. 2 illustrates how a collapsible golf bag in accordance with the subject invention can be carried on a standard golf bag while the standard golf bag is attached to a golf cart.
Figure 9:
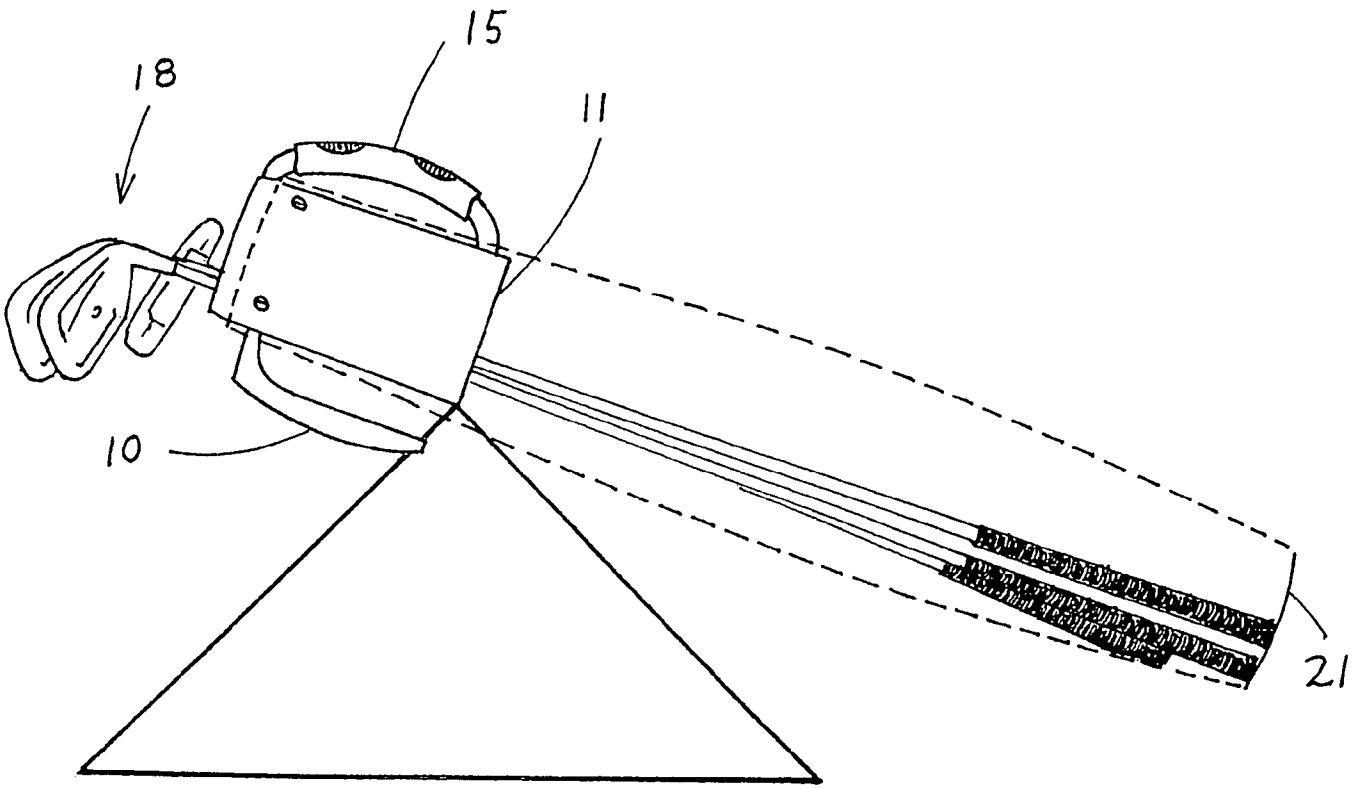
FIG. 9 illustrates how the subject collapsible golf bag can be positioned against an object and how the handle can be used to stabilize the collapsible golf bag.
Figure 10:
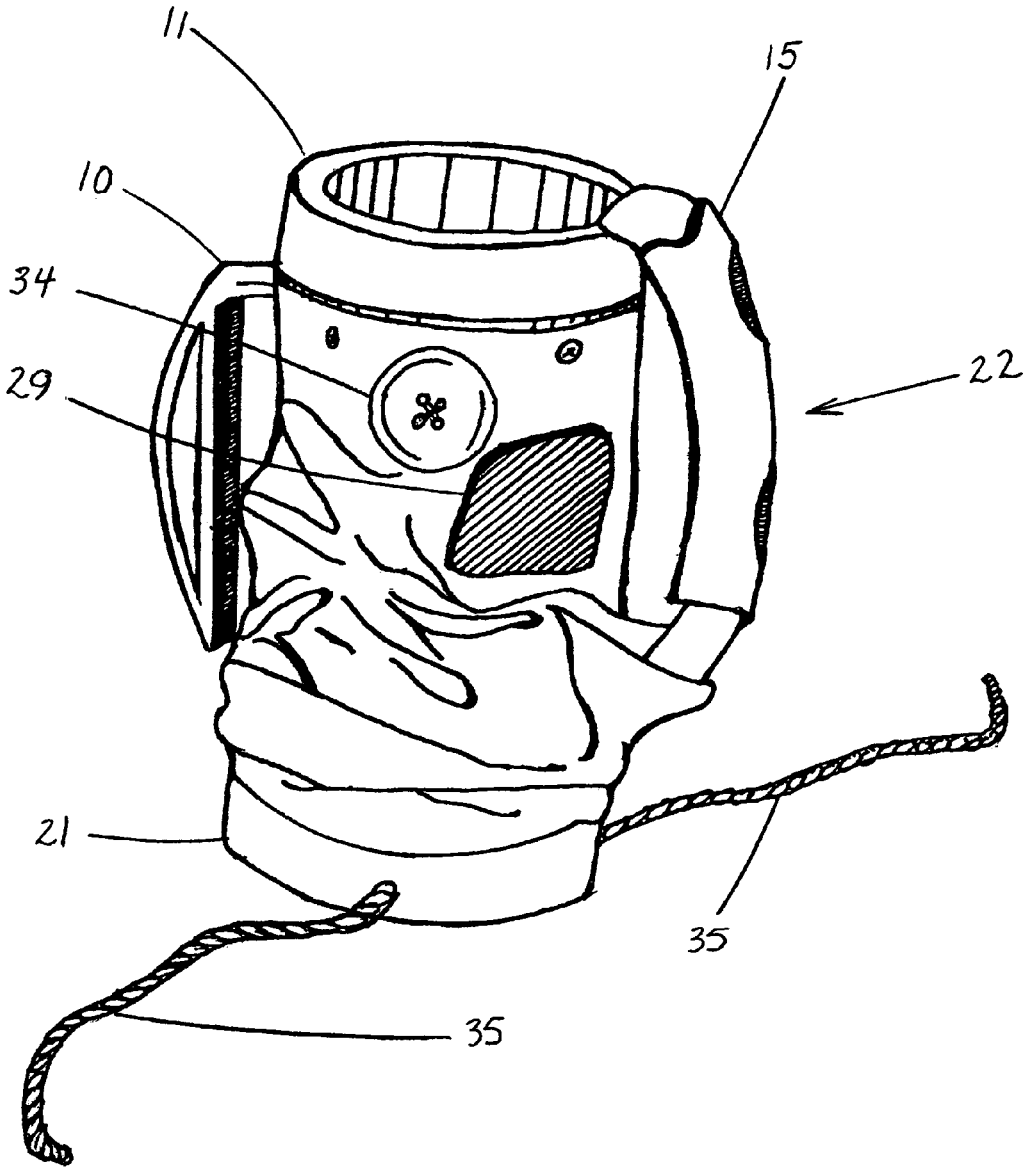
FIG. 10 shows alternative holding means of buttons and ties, a corresponding set of a button and a tie is positioned on the opposite side of golf bag.
Figure 11:
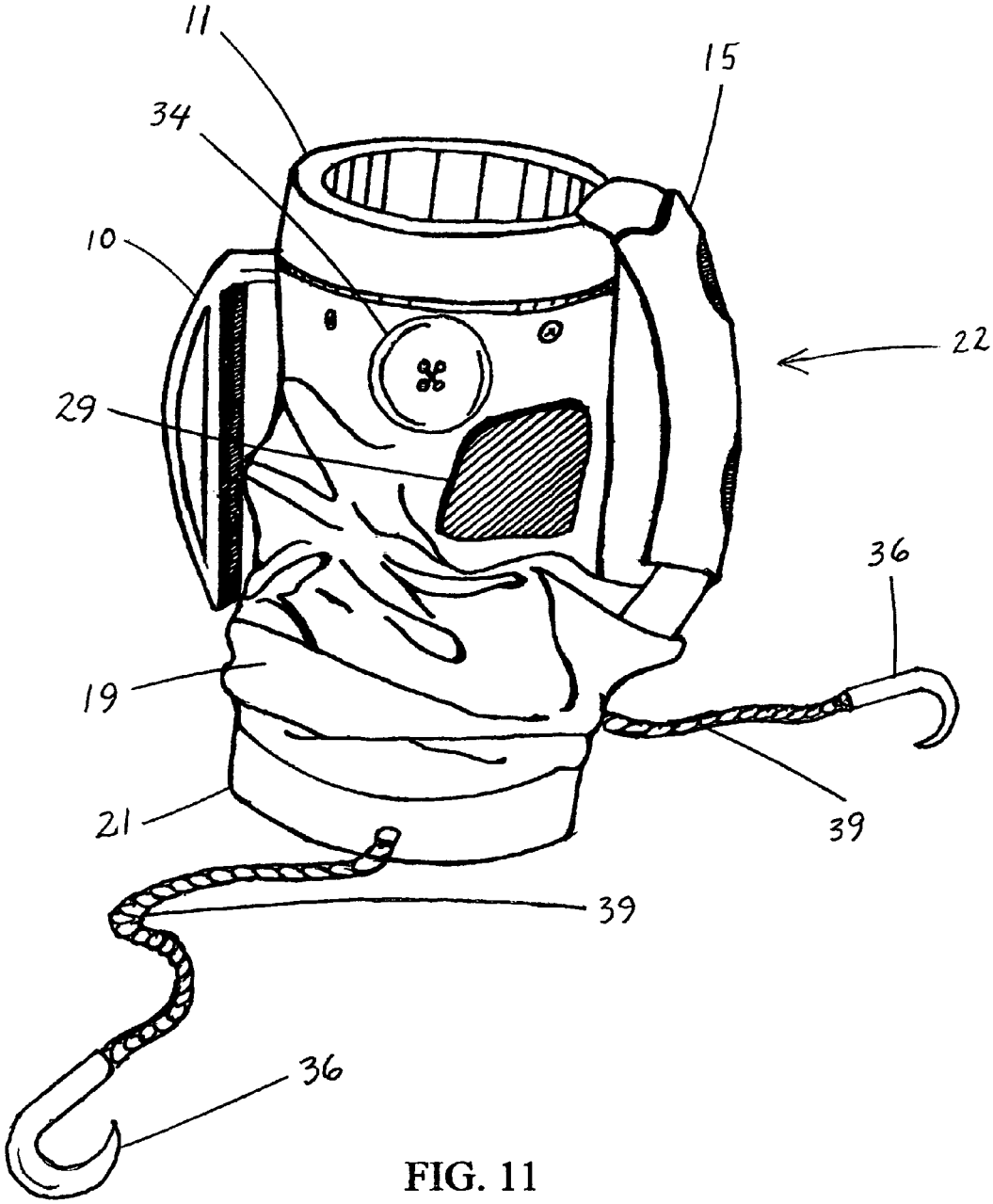
FIG. 11 shows alternative holding means of strings and hooks, a corresponding set of a string and a hook is positioned on the opposite side of golf bag.
Figure 12:
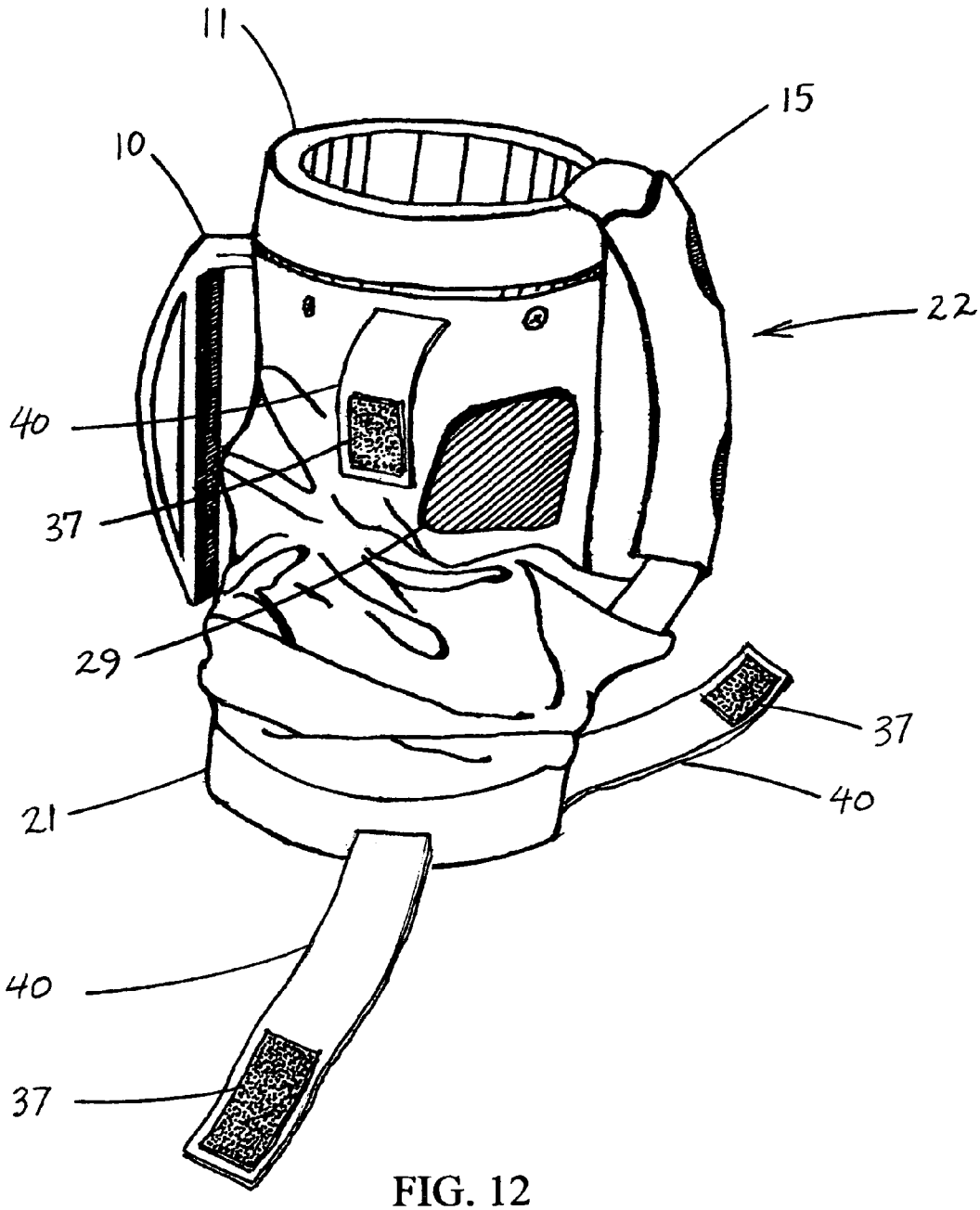
FIG. 12 shows alternative holding means of hook and loop material and straps, a corresponding set of a hook and loop material and a strap is positioned on the opposite side of golf bag.
Figure 13:
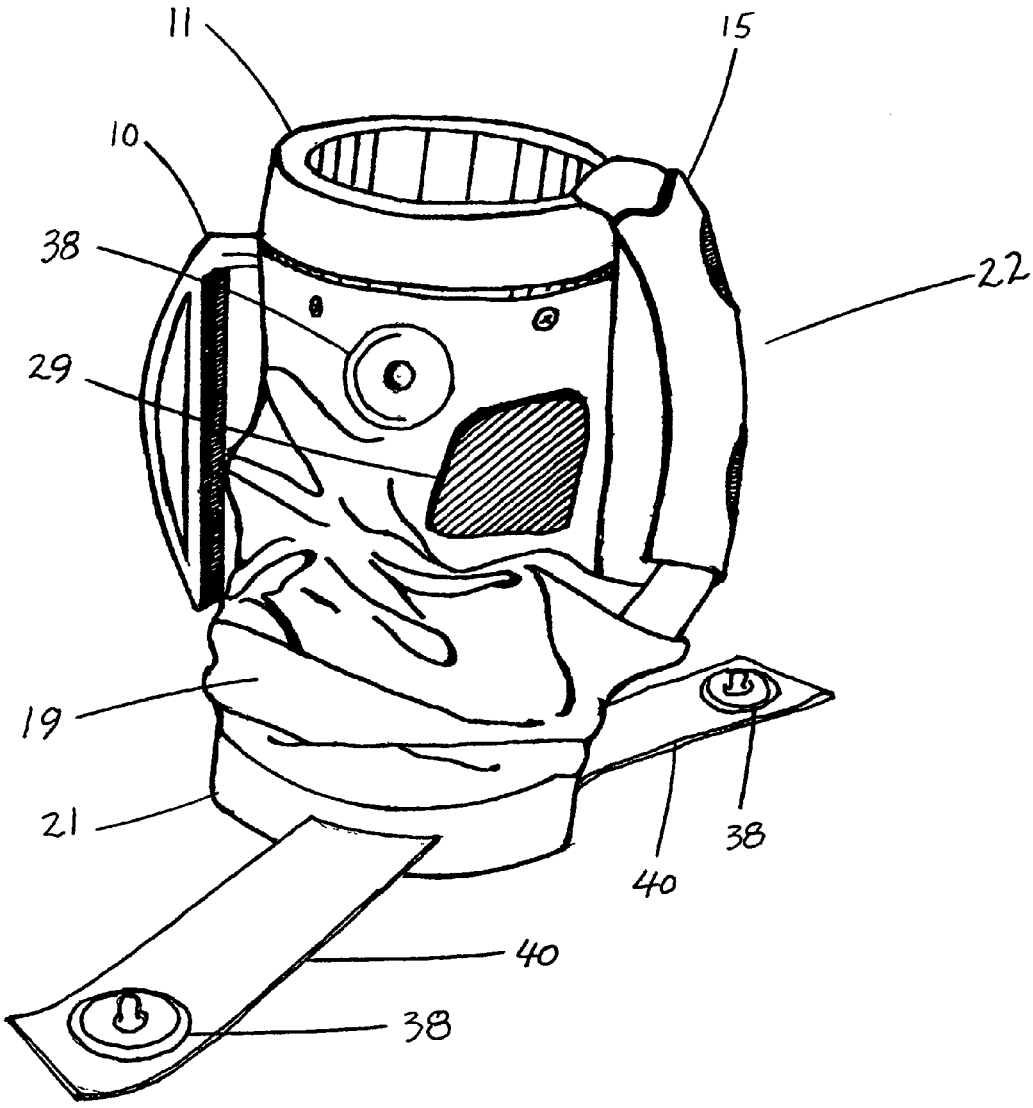
FIG. 13 shows alternative holding means of snaps and straps, a corresponding set of a snap and a strap is positioned on the opposite side of golf bag.

The subject invention pertains to a golf bag for carrying golf clubs. The subject invention also relates to a golf bag, which can attach and detach from any standard, non-mating golf bag, while simultaneously containing as many as nine golf clubs. In a specific embodiment, the subject golf bag can be collapsible for easy carrying or storage. FIG. 1 illustrates a specific embodiment, of a golf bag 22 in accordance with the subject invention a universal hook 10 that may protrude downward from a collar 11 or other portion of the golf bag. This universal hook can be of any shape or material which could be slidably attachable to, for example, a standard golf bag 12. The golf bag 22 can hang from virtually any standard golf bag 12 or structure of a motorized golf cart, such as a rack and strapping system 13 that holds golf bags, as shown in FIG. 2. As shown in FIG. 9, the universal hook can also be used to simply stabilize the collapsible golf bag when leaned against another object. When attached to a standard golf bag 12, golf cart, or other object, the subject golf bag 22 can hang in a vertical manner such that the bag is essentially perpendicular to the ground as illustrated in FIG. 2. When attached to a standard golf bag, the subject golf bag can hang such that its main body portion 14 is parallel to the standard golf bag, as illustrated in FIG. 2. However, when needed, a golfer can grasp a handle 15, and lift the golf bag 22 vertically up and away from a full size golf bag 12, golf cart, or other object.

Figure 3:
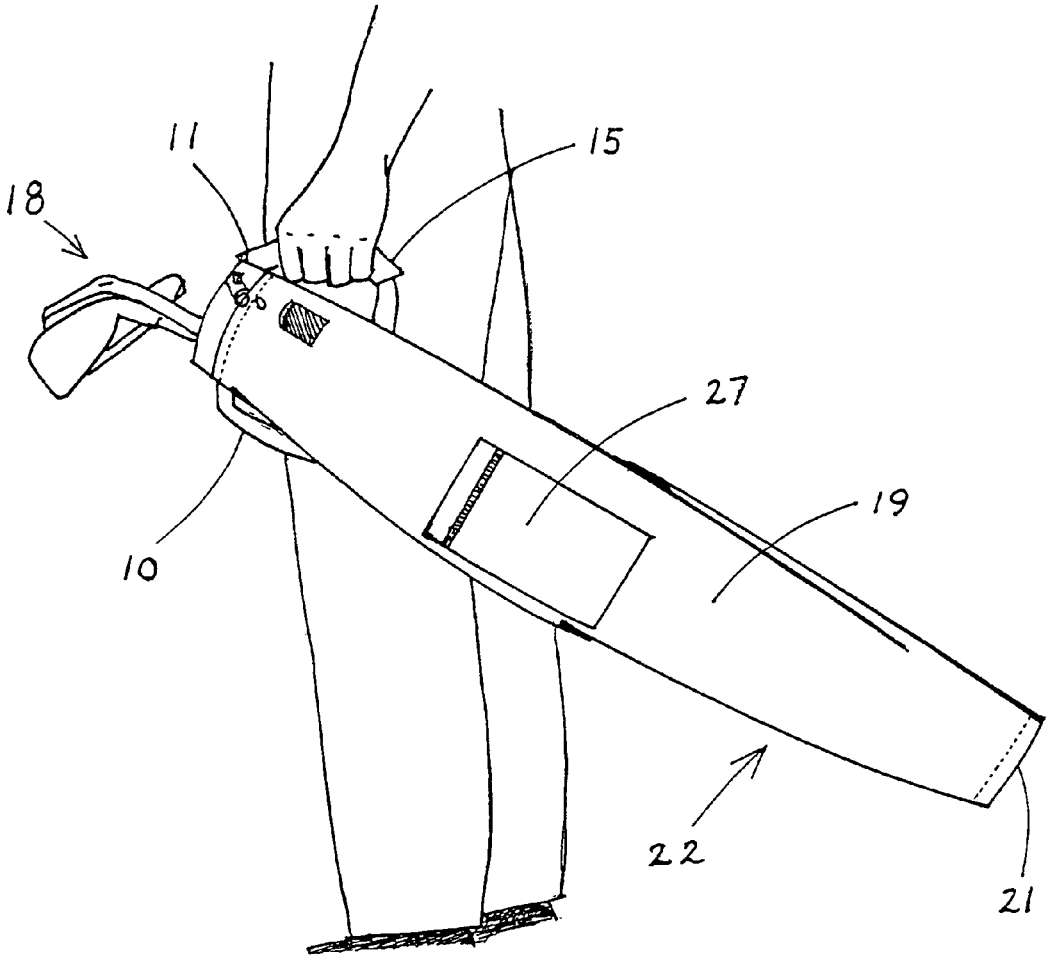
FIG. 3 shows how a specific embodiment of the subject golf bag can be carried by a handle for transport when not attached to a standard golf bag or other object.

The collar 11 can be rigid or resiliently flexible. The collar can hold the outer sleeve 19 and/or inner liner, or sleeve, 17 open such that golf clubs can be inserted into the subject golf bag. In a specific embodiment, the collar can be tubular. In other embodiments, the collar 11 can be a partial ring, for example C-shaped, ring shaped, or other shape which holds inner and/or outer sleeves of the golf bag open for the reception of golf clubs. In a specific embodiment, the collar 11 balances the weight of clubs 18 at a comfortable angle, as illustrated in FIG. 3. The handle may be of any material or design known in the art which would allow the subject golf bag to be lifted and carried. In a specific embodiment, a shoulder strap or thong-type carrying device can be utilized.

Extending from the collar is the main body portion 14 which can comprise an inner liner or sleeve 17 or interior bag that could be utilized to support the weight of golf clubs 18, while the outer sleeve 19 can be used primarily for color, pockets and attachment of accessories. The inner liner 17 can relieve the outer sleeve 19 of stress and/or stretching exerted by the weight of contained clubs 18, allowing a relaxed and more aesthetic appearance. However, an inner liner 17 not required if the outer sleeve 19 is constructed of a material that achieves all of the desired characteristics.

In a preferred embodiment, both the inner liner 17, if utilized, and the outer sleeve 19 can be of a material that can be crushed or folded so as not to inhibit the collapsibility of the golf bag 22. Thus, a vast array of materials may be used for the outer sleeve 19 and/or inner liner 17 of the main body portion 14, such as nylon, nylon oxford, canvas, broadcloth, ballistic or rip-stop nylon, and/or tubular plastic, as shown in FIG. 1. Because the inner liner 17 and the outer sleeve 19 may have different functions, it is conceivable, but not necessary, that they may each be comprised of different types of materials.

Figure 4:
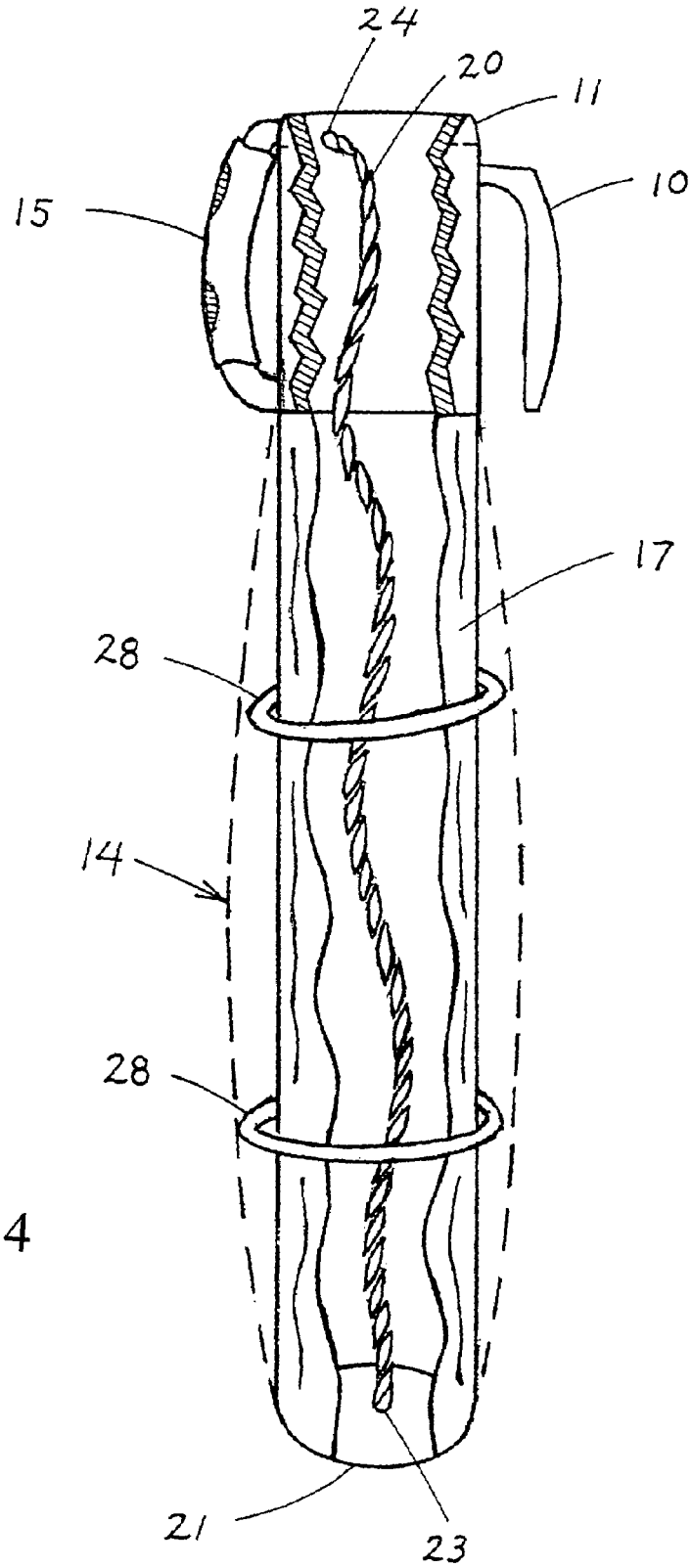
FIG. 4 shows a broken view of a specific embodiment of a collapsible golf bag in accordance with the subject invention showing pulling means which is attached to the reinforced bottom end.
Figure 5:
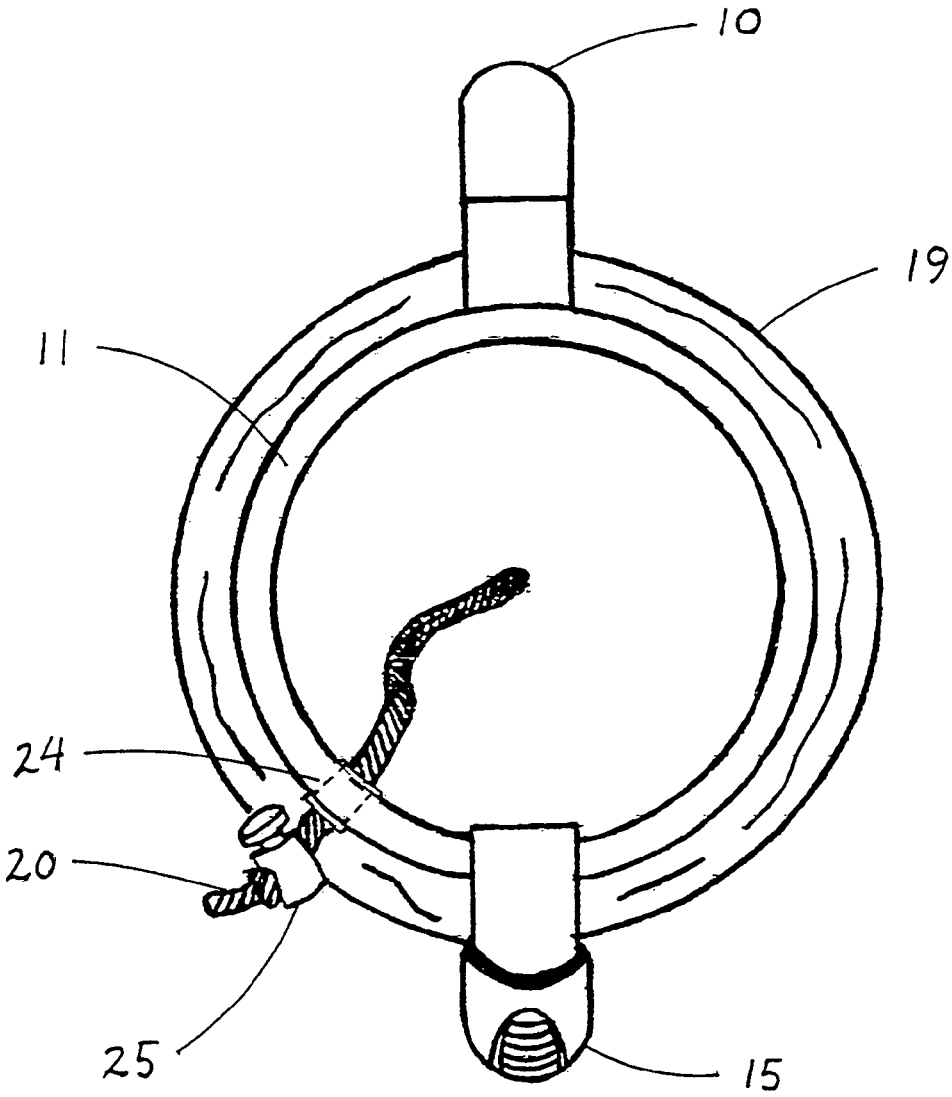
FIG. 5 shows a top view of a specific embodiment of the subject collapsible golf bag showing a holding means attached to a pulling means.
Figure 6:
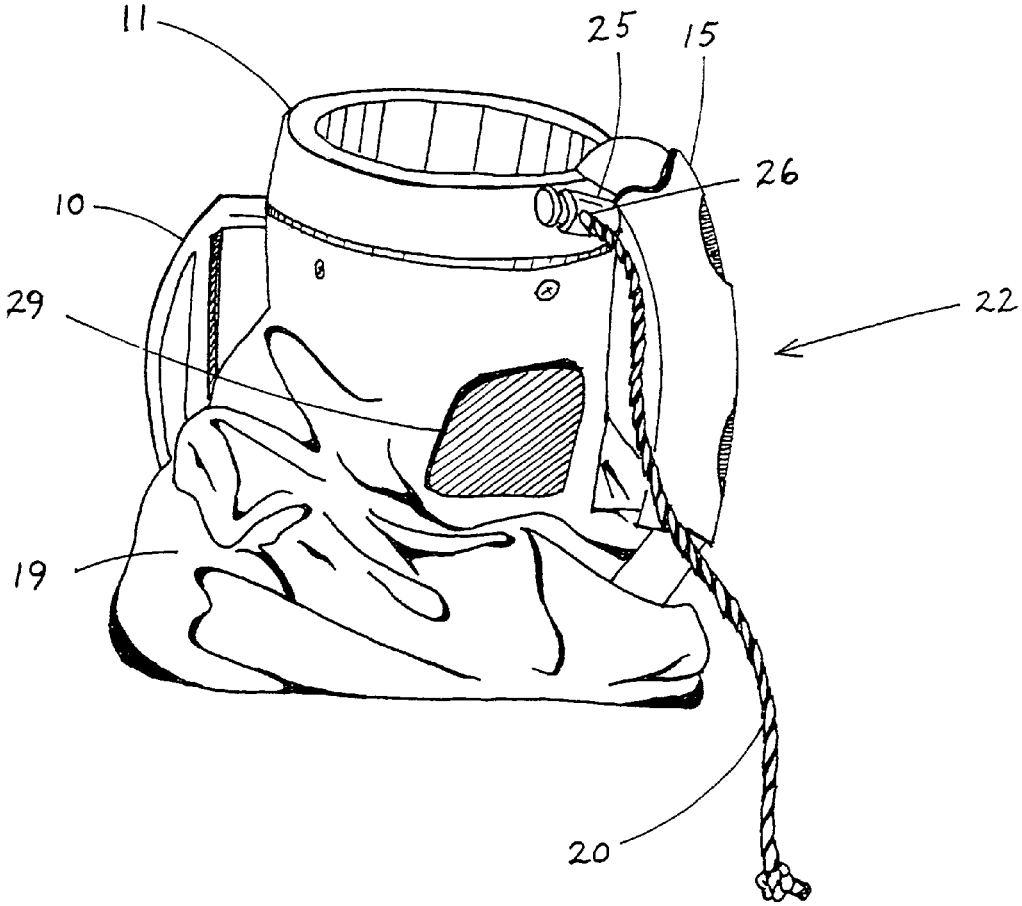
FIG. 6 illustrates the collapsed position of a specific embodiment of the subject collapsible golf bag.

The subject golf bag can also have an apparatus to assist in collapsing the golf bag. Such collapsing apparatus could comprise any length of material such as a string, cord, rope, fabric, chain or similar object, which is attached to a portion of the golf bag such as the bottom end. In a specific embodiment, a cord is attached to a rigid piece 21 such that pulling the cord can aid in the compression of the collapsible golf bag 22. Such an apparatus could comprise an object of sufficient length that it can be secured to, for example, the center 23 of the reinforced bottom 21 of the collapsible golf bag. In a specific embodiment the cord can extend along the interior of the main body portion 14 between inner liner 17 and outer sleeve 19 (as shown in FIG. 4), and protrude through an opening 24 located near the top of the collapsible bag. In a preferred embodiment, a drawstring or cord 20 is attached to the center of a rigid reinforcing bottom piece and extended the entire length of the expanded collapsible golf bag so that it protrudes through an opening 24 in the collar of the collapsible golf bag 22, as shown in FIG. 5. At a point on the drawstring or cord 20, located exterior of the collar 11, could be a clamp 25, which may be a spring-loaded pressure type clamp (FIG. 5). By pulling the drawstring 20 away from the collar 11, the collapsible golf bag 22 is forced into a collapsed or compressed mode. The clamp 25 may be repositioned down and along the drawstring 20 as it is extruded from the main body portion 14 and fixed to stay at a point 26 so as to keep the collapsible golf bag 22 from extending as shown in FIG. 6. The extruded length of drawstring 20 can now be placed into the collar portion 11 of the collapsible golf bag 22, out of the way. While a drawstring or cord 20 is the preferred embodiment, any method such as hook and loop, buttons, buckles or any other type of fastener may be used to compress the collapsible golf bag 22. In a specific embodiment, a collapsing device may not be necessary because the two ends of the collapsible golf bag could be pushed together by hand and held in place with any device known in the art.

One or more pockets 27 may be positioned on or along the main body portion 14 without hampering the collapsible operation. Such pockets may be closable by hook and loop, zippers, buttons, ties but should not be limited to those mentioned.

Rigid supports, such as hoops or various shaped ribs 28 could be implemented within the main body portion 14 between the inner liner 17 and the outer sleeve 19 to maintain the shape of collapsible golf bag 22 when fully open. If an inner liner 17 is not utilized with the subject invention, then the hoops or ribs 28 can be attached either inside or outside the outer sleeve 19 to aid in maintaining the shape of the collapsible golf bag when extended. The circumference of the hoops or ribs 28 can be of various shapes, including but not limited to circular, square, oval, triangular, rectangular or combinations thereof, and may be flattened, rounded, or squared in cross-section. The hoops can comprise a variety of materials, including, but not limited to, various types plastics or rubbers, metals, woods, combinations thereof, etc. The hoops 28 may be rigid enough to support the weight of the main body portion 14 to hold the bag in an open or semi-open position when extended. In a preferred embodiment the hoops or ribs 28 are of the same cross-sectional shape and diameter as the collar.

In a further embodiment, a spiraled spring, biased to expand, could be positioned lengthwise along main body portion 14 between the inner liner 17 and the outer sleeve 19, to maintain full open mode. However, when the drawstring 20 is pulled, the body would collapse as the spring is compressed. This type of construction may aid in two ways; first, it would help give shape to the collapsible golf bag 22 and secondly, if spring is firm enough, when mini golf bag 22 is stood upright with accompanying clubs 18, the collar 11 would not slide down. The spring may comprise, but is not limited to, plastic, metal, rubber, or other material.

In a further alternate embodiment, an elastic cord could be affixed to collar 11 and the rigid bottom piece 21, to impose a collapsed bias to the main body portion 14. The insertion of golf clubs 18 would appropriately extend the golf bag 22 for use.

A hook or loop patch 29 could be mounted or attached to golf bag 22 for the attachment of a golf glove 30 or other items when not needed. This eliminates the need to shove the glove or other item into a pants pocket. Either the hook or loop material can be placed so as to receive the opposite hook or loop material of the golf glove 30 or other item. Such placement of hook or loop on the collapsible golf bag 22 maintains convenient and close proximity of the glove 30 or other item while reducing the possibility of it being lost or misplaced.

Further, a ring 31 of some sort may be sewn onto the collapsible golf bag 22 for the attachment of a golf towel 32 or other item. This feature allows the transport, and close proximity of a golf towel 32 or other item.

A tote bag 33 could be provided for storage.

In a preferred embodiment the collapsible golf bag 22 can carry a plurality of clubs, but usually less than a full set and comprises a rigid collar 11 approximately 5 inches in outer diameter and approximately 6 inches in length. A rigid handle, approximately 5 inches in length, can be attached to the top and bottom of the collar 11 and is parallel to the length of the collar for lifting and carrying the collapsible golf bag 22. A rigid universal type hook 10 approximately 4 inches long can be attached opposite the handle and near the upper portion of the collar 11 and extends parallel to the handle 15. The main body portion 14 comprises an outer sleeve 19 surrounding an inner liner 17, each approximately 33" long, wherein the upper open end of the sleeve 19 and the upper open end of the inner liner 17 are attached around the bottom circumference of the collar 11. Approximately 2–3 rigid circular hoops 28 can be attached between the inner liner 17 and the outer sleeve 19. These circular hoops 28 can have any type of circumferential shape, e.g., circular, oval, square, rectangle, etc., and may have flanges, eyelets, holes, grooves, etc. which allow them to be secured between the inner liner 17 and the outer sleeve 19. The preferred embodiment uses circular hoops.

The preferred embodiment can further comprise a rigid bottom piece 21 to which may be attached the ends of the inner liner 17 and the outer sleeve 19 of the main body portion 14 opposite the collar 11 end. The bottom end of main body portion 14 opposite the collar is attached around the circumference of the rigid bottom piece 21 so that when the collapsible golf bag stand upright, as in FIG. 4, the rigid bottom piece 21 would be in contact with the ground, golf cart, or other object on which it is standing in an upright position.

The preferred embodiment would also comprise a drawstring mechanism 20 for collapsing or compressing the bag. The drawstring mechanism 20 can be attached to the center 23 of the rigid bottom piece 21 and, when the collapsible golf bag is fully open, would extend freely between the inner liner 17 and the outer sleeve 19 up to the collar 11 which has an opening whereby the drawstring can exit from between the inner liner 17 and the outer sleeve 19. By pulling the exposed drawstring 20 away from the collar, the rigid bottom piece 21 of the collapsible golf bag is pulled towards the collar 11 end of the golf bag, thus compressing the inner liner 17, the outer sleeve 19 and the circular hoops 28 therein to a size approximately 6 inches–7 inches tall and approximately the same diameter as the collar 11, about 5 inches.

Figure 7:
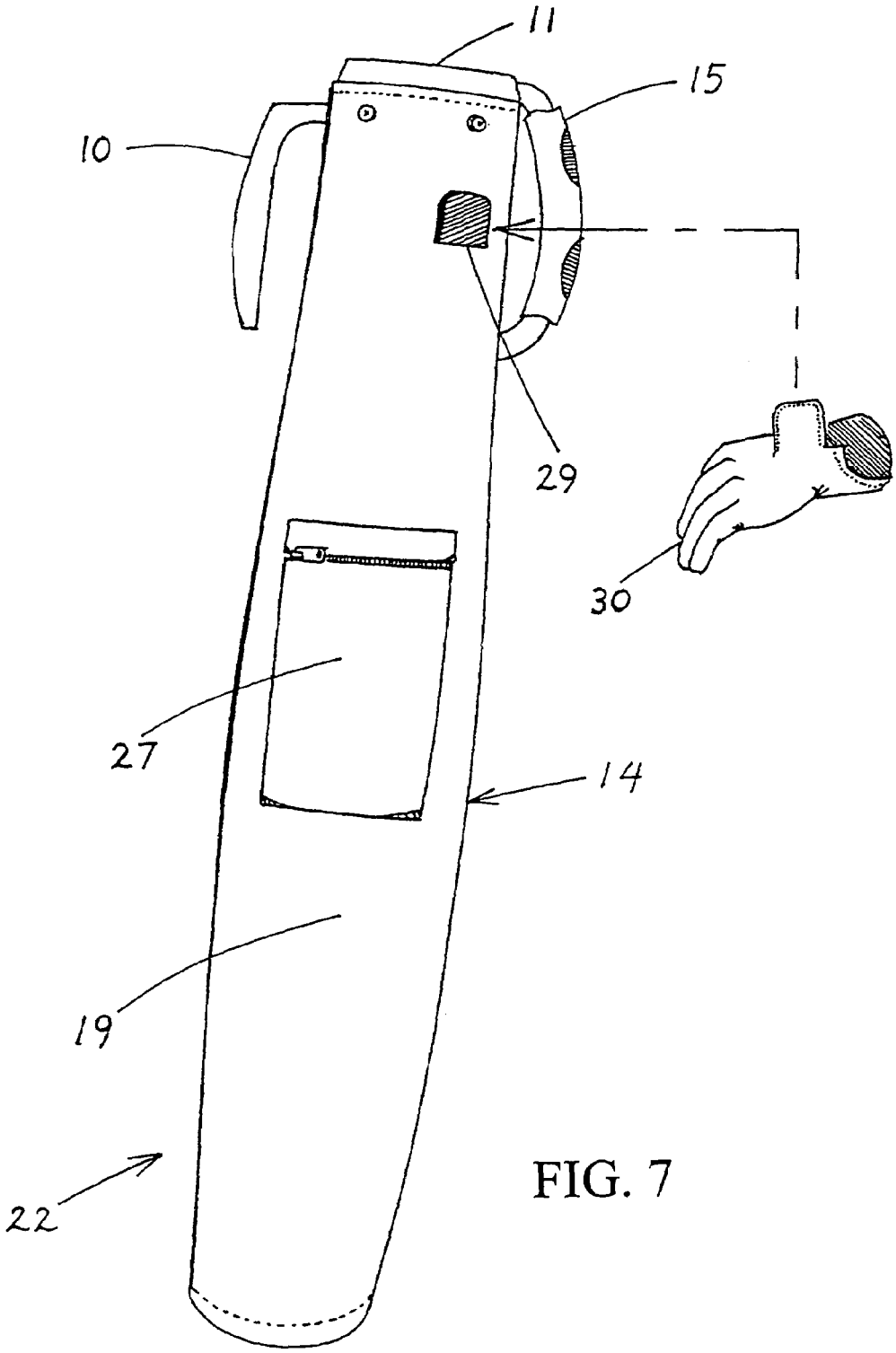
FIG. 7 shows an embodiment of the subject collapsible golf bag with various accessories and attachments, including a pocket and a hook and loop patch for attaching, for example, a golf glove.
Figure 8:
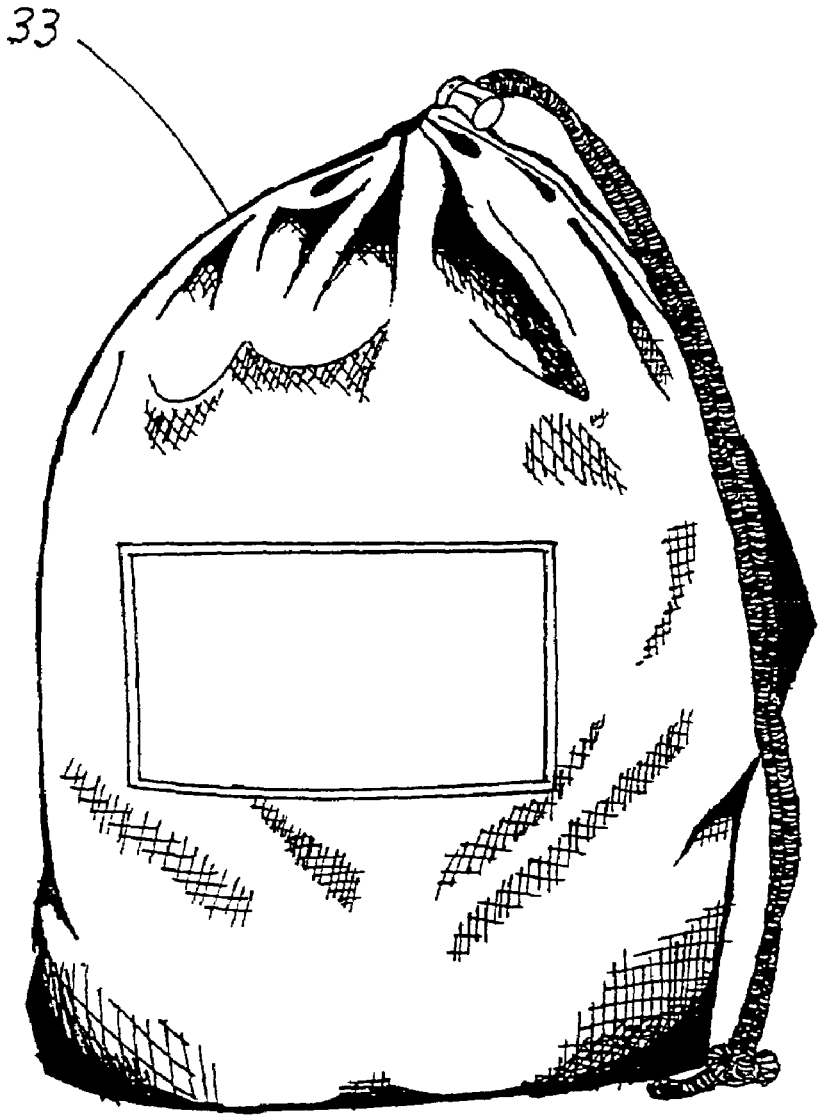
FIG. 8 shows an example of how the subject collapsible golf bag can be stored in a tote bag.

The preferred embodiment would have a hook and loop patch 29, essentially as shown in FIG. 7, for attaching a golf glove 30. It could also have one or more pockets 27 which could be closeable and a ring 31 attached to the collapsible golf bag 22 for attaching a towel 32 to the collapsible golf bag 22. Generally, any feature that you may find on a standard golf bag could be incorporated into or onto the collapsible golf bag 22, for example dividers and/or rain hoods.

In another embodiment, the collapsible golf bag 22 would be essentially as described above, but, if necessary, could have a larger diameter collar 11 and larger inner liner 17 and outer sleeve 19 for carrying a full set of golf clubs In another embodiment, golf bag would be essentially described as above, however the holding means may consist of buttons 34 and ties 35, where ties 35 would be wound around buttons 34 so as to hold golf bag in a closed position. Another embodiment may consist of strings 39 and hooks 36, where hooks 36 positioned at the ends of strings 39 could be hooked around a button 34 or similar catching means to hold golf bag in a closed position. Further, another embodiment for a holding means may consist of hook and loop material 37 and straps 40, where the hook and loop 37 material and straps 40 could be attached to a counterpart hook and loop 37 and strap 40 to hold the golf bag in a closed position. In another embodiment, a closing means may consist of snaps 38 and straps 40, where the snaps 38 and straps 40 could be connected to counterpart snaps 38 and straps 40 to hold the golf bag in a closed position. The golf bag can be held collapsed by a variety of means known in the art.

The invention is designed to be a fully functional and integral part of modern cart golf. This revolutionary approach will provide convenience, increased speed of play, effective course management and the prevention of lost clubs. But, of most importance, the invention will allow more shot options to the golfer, thereby improving the golfer's skill. Which will improve his scoring, confidence in shot making and confidence in his game.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

I claim:

1. A single unit golf bag invention for carrying several golf clubs that can be releasably attached to any standard, non-mating golf bag or to a golf cart structure, comprising:

a collar of sufficient cylindrical length and rigidity to suspend the golf bag and said several golf clubs in a vertical manner while attached to any standard, non-mating golf bag or golf cart structure;

a tubular sleeve with an upper end and a closed lower end, wherein the collar is attached to the upper end of the sleeve;

an attachment means for attaching and hanging the golf bag to said standard, non-mating golf bag or said golf cart structure while simultaneously containing said several clubs.

2. The golf bag according to claim 1, wherein the closed end, further comprising a bottom piece attached to the lower end of said sleeve whereby said bottom piece acts as a platform for said several golf clubs while said golf bag is suspended vertically from said standard, non-mating golf bag or said golf cart structure.

3. The golf bag according to claim 2, wherein said bottom piece is essentially rigid whereby providing a stable platform for said several golf clubs while said golf bag is suspended vertically from said standard, non-mating golf bag or said golf cart structure, whereby holding said several golf clubs at level.

4. The golf bag according to claim 2, wherein said sleeve comprises a resiliently flexible material, allowing said golf bag to be collapsible in a longitudinal manner.

5. The golf bag according to claim 4, wherein said bottom piece can be moved towards the lower end of said collar so as to collapse said sleeve between said bottom piece and said collar.

6. The golf bag according to claim 5, further comprising a holding means to keep said golf bag collapsed, where said holding means is selected from the group consisting of: buttons, ties, hooks, hook and loop material, snaps, strings, and straps.

7. The golf bag according to claim 5, further comprising a cord, whereby rendering said golf bag collapsed, where said cord is attached to the interior of said bottom piece and traverses longitudinally upward and through an opening near the top of said collar.

8. The golf bag according to claim 7, further comprising:

said holding means where holding means is a spring loaded stay, whereby keeping golf bag in a collapsed state, by preventing said cord from releasing through said collar, which would extend bag.

9. The golf bag according to claim 1, wherein said attachment means is a universal hook extending from said collar and downward, where said golf bag can be attached to any standard, non-mating golf bag by placing said hook over any portion of said standard golf bag's brim or golf cart structure, whereby the golf bag is suspended vertically from said collar.

10. The golf bag according to claim 1, wherein said tubular sleeve is comprised of a resiliently flexible material, so as to provide an effective means to suspend said several golf clubs from a brim of said standard, non-mating golf bag, or said golf cart structure, whereby absorbing shock and vibration resulting from travel in a motorized golf cart, reducing damage to the clubs.

11. The golf bag according to claim 10, wherein said sleeve of resiliently flexible material provides a pliable outer surface whereby aiding proper suspension of said golf bag and coupling to said standard, non-mating golf bags by flexibly conforming to surface variations found on different types of standard golf bags, allowing a vertical hanging position.

12. The golf bag according to claim 1, further comprising at least one handle, wherein said handle is connected directly to said collar, whereby a golfer can manipulate lateral and vertical movement of said golf bag needed to position and attach said golf bag to said standard, non-mating golf bag or said golf cart structure.

13. The golf bag according to claim 12, wherein said handle and said collar assist in creating a balance point on said several golf clubs for the manual transport of said several golf clubs.

14. The golf bag according to claim 1, further comprising at least one pocket spaced along the length of the golf bag, so as to assist in the balancing of golf bag whereby the insertion of articles create a weight to counter-balance any forward tipping caused by longer clubs or heavy headed golf clubs.

15. The golf bag according to claim 1, further comprising: said attachment means for and hanging said golf bag to said standard, non-mating golf bag or said golf cart structure, which comprises one or more mechanisms selected from the group consisting of; a hook(s), clamps, straps, ties, fasteners, grips, stays, or connections.

16. The golf bag according to claim 1, further comprising: a flexible bag for the storage of said golf bag.

* * * * *